US011468766B2

(12) United States Patent
Lucas et al.

(10) Patent No.: US 11,468,766 B2
(45) Date of Patent: Oct. 11, 2022

(54) OBSTRUCTION DETECTION SYSTEM

(71) Applicant: Xorail, Inc., Berwick, PA (US)

(72) Inventors: James Lucas, Wilmerding, PA (US); Brad Von Tersch, Wilmerding, PA (US); Mike Kirchner, Wilmerding, PA (US)

(73) Assignee: Xorail, Inc., Berwick, PA (US)

( * ) Notice: Subject to any disclaimer, the term of this patent is extended or adjusted under 35 U.S.C. 154(b) by 44 days.

(21) Appl. No.: 16/733,465

(22) Filed: Jan. 3, 2020

(65) Prior Publication Data

US 2021/0209936 A1 Jul. 8, 2021

(51) Int. Cl.

| | |
|---|---|
| ***G08G 1/01*** | (2006.01) |
| ***B61L 23/34*** | (2006.01) |
| ***G08G 1/0967*** | (2006.01) |
| ***G08G 1/04*** | (2006.01) |
| ***G08G 1/127*** | (2006.01) |
| ***G08G 1/052*** | (2006.01) |
| ***G08G 1/16*** | (2006.01) |
| ***G08G 1/0962*** | (2006.01) |
| ***B61L 23/04*** | (2006.01) |

(52) U.S. Cl.

CPC ..... *G08G 1/0116* (2013.01); *B61L 23/041* (2013.01); *B61L 23/34* (2013.01); *G08G 1/04* (2013.01); *G08G 1/052* (2013.01); *G08G 1/09623* (2013.01); *G08G 1/096783* (2013.01); *G08G 1/096791* (2013.01); *G08G 1/127* (2013.01); *G08G 1/161* (2013.01)

(58) Field of Classification Search

CPC .. G08G 1/0116; G08G 1/161; G08G 1/09623; G08G 1/096783; G08G 1/096791; G08G 1/04; G08G 1/127; G08G 1/052; B61L 23/34; B61L 23/041

See application file for complete search history.

(56) References Cited

U.S. PATENT DOCUMENTS 5,890,682 A * 4/1999 Welk ..... B61L 29/24 246/126
6,088,635 A * 7/2000 Cox ..... B61L 23/041 701/19

(Continued)

OTHER PUBLICATIONS

Island Radar, "Train Detection", Wavetronix Company, 2019.

(Continued)

*Primary Examiner* — Dale W Hilgendorf

(74) *Attorney, Agent, or Firm* — Christopher R. Carroll; The Small Patent Law Group LLC

(57) ABSTRACT

A system includes one or more processors. The one or more processors are configured to receive crossing obstruction information from an optical sensor disposed proximate a crossing of a route traversed by a vehicle, with the crossing obstruction information indicating a presence of an obstruction to the crossing; obtain position information indicating a position of the vehicle traversing the route; determine proximity information of the vehicle indicating proximity of the vehicle to the crossing using the position information; determine a presence or absence of an alert state indicating a potential of the crossing being obstructed using the crossing obstruction information and the proximity information; and perform a responsive activity based responsive to a determination of the presence of the alert state.

25 Claims, 4 Drawing Sheets

(56) References Cited

U.S. PATENT DOCUMENTS

| | | | | |
|---|---|---|---|---|
| 8,909,396 | B2 * | 12/2014 | Hilleary | B61L 29/30 701/19 |
| 2007/0040070 | A1 * | 2/2007 | Stevenson | B61L 29/30 246/122 R |
| 2008/0169939 | A1 * | 7/2008 | Dickens | G08G 1/02 340/910 |
| 2011/0084176 | A1 * | 4/2011 | Reichelt | B61L 29/30 246/473.1 |
| 2012/0182140 | A1 * | 7/2012 | Kumabe | G08G 1/161 340/435 |
| 2013/0018534 | A1 | 1/2013 | Hilleary | |
| 2014/0005905 | A1 | 1/2014 | Kanner | |
| 2014/0218482 | A1 * | 8/2014 | Prince | B61L 29/32 348/47 |
| 2016/0046308 | A1 * | 2/2016 | Chung | B61L 23/041 701/20 |
| 2016/0097849 | A1 * | 4/2016 | Nichols | G08G 1/096716 342/107 |
| 2016/0200334 | A1 * | 7/2016 | Hilleary | B61L 23/041 246/218 |
| 2018/0222506 | A1 * | 8/2018 | Kranz | B61L 23/04 |
| 2019/0077429 | A1 | 3/2019 | D'Amico | |
| 2019/0145791 | A1 * | 5/2019 | Rempel | B61L 29/32 701/410 |
| 2019/0146520 | A1 * | 5/2019 | Naithani | B61L 23/047 701/28 |
| 2020/0234578 | A1 * | 7/2020 | Zhang | G08G 1/0112 |
| 2021/0004611 | A1 * | 1/2021 | Garimella | G08G 1/04 |
| 2021/0107540 | A1 * | 4/2021 | Lucas | B61L 29/30 |

OTHER PUBLICATIONS

Examination Report dated Nov. 23, 2021 for corresponding Australian Application No. 2020294236 (3 pages).

Examiner's Requisition from CIPO for corresponding Canadian Patent Application No. 3,103,898 (5 pages).

Examination Report No. 2 dated Mar. 29, 2022 for corresponding Australian Application No. 2020294236 (4 pages).

Examiner's Requisition dated Mar. 24, 2022 for corresponding Canadian Patent Application No. 3,103,898 (6 pages).

First examination report dated May 5, 2022 for corresponding Indian Patent Application No. 202014055901 (10 pages).

* cited by examiner

OBSTRUCTION DETECTION SYSTEM

BACKGROUND

Technical Field

The subject matter described relates to systems and methods that monitor route crossings or other locations to determine whether obstructions exist and that can warn approaching vehicles of the obstructions.

Discussion of Art

Many vehicles travel on routes that cross each other. For example, rail vehicles travel along tracks that may intersect with a road at a crossing. Another vehicle (e.g., an automobile) may obstruct the crossing by being in the crossing in a location that would result in a collision with the rail vehicle if the rail vehicle were to travel through the crossing. For example, the automobile may become trapped between lowered gates or the automobile may be experiencing failures resulting in an inability of the automobile to move out of the crossing.

Some known systems detect the presence of an automobile in a crossing using radar and provide warnings to railroad personnel. But, these warnings may be missed by the personnel. Further, depending on the distance of a vehicle to the crossing, there may be a relatively large number of false positives that may inhibit efficiency of a crossing detection system or its use.

BRIEF DESCRIPTION

In one embodiment, a system includes one or more processors configured to receive crossing obstruction information from an optical sensor disposed proximate a crossing of a route traversed by a vehicle. The crossing obstruction information indicates a presence of an obstruction to the crossing. The one or more processors are also configured to obtain position information indicating a position of the vehicle traversing the route. Also, the one or more processors are configured to determine proximity information of the vehicle indicating proximity of the vehicle to the crossing using the position information. Further, the one or more processors are configured to determine a presence or absence of an alert state indicating a potential of the crossing being obstructed using the crossing obstruction information and the proximity information, and to perform a responsive activity responsive to a determination of the presence of the alert state.

In one embodiment, a method includes receiving crossing obstruction information from an optical sensor disposed proximate a crossing of a route traversed by a vehicle, the crossing obstruction information indicating a presence of an obstruction to the crossing. The method also includes obtaining position information from the vehicle indicating a position of the vehicle traversing the route, and determining proximity information of the vehicle indicating proximity of the vehicle to the crossing using the position information. Further, the method includes determining a presence or absence of an alert state indicating a potential of the crossing being obstructed using the crossing obstruction information and the proximity information. The method also includes performing a responsive activity responsive to a determination of the presence of the alert state.

In one embodiment, a system includes an optical sensor, a position sensor, and one or more processors. The optical sensor is disposed proximate a crossing of a route traversed by a vehicle, and is configured to obtain crossing obstruction information indicating a presence of an obstruction to the crossing. The position sensor is configured to be disposed onboard the vehicle, and is configured to obtain position information indicating a position of the vehicle traversing the route. The one or more processors are configured to receive the crossing obstruction information from the optical sensor; obtain the position information from the position sensor; determine proximity information of the vehicle indicating proximity of the vehicle to the crossing using the position information; determine a presence or absence of an alert state indicating a potential of the crossing being obstructed using the crossing obstruction information and the proximity information; and perform a responsive activity responsive to a determination of the presence of the alert state.

BRIEF DESCRIPTION OF THE DRAWINGS

The inventive subject matter may be understood from reading the following description of non-limiting embodiments, with reference to the attached drawings, wherein below.

DETAILED DESCRIPTION

Figure 1:
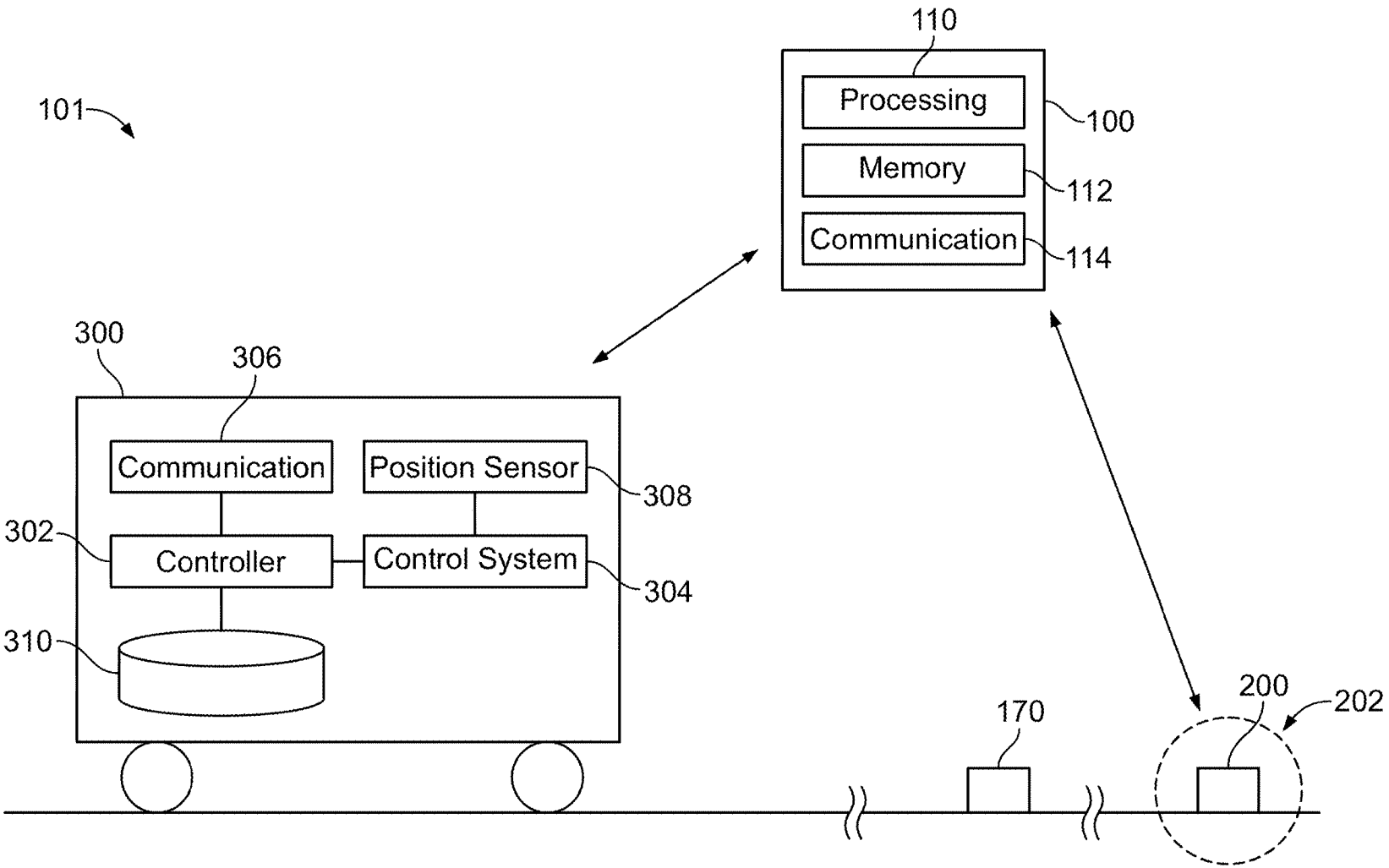
FIG. 1 illustrates a block schematic diagram of a network that includes an obstruction alert system, a wayside detection system, and a vehicle.

Embodiments of the subject matter described herein relate to systems and methods that determine whether an obstruction is present in a crossing of a route and that notify vehicles approaching the crossing of the obstruction so that the vehicles can change movement to avoid colliding with the obstruction. Additional discussion regarding detection of obstructions may be found in U.S. patent application Ser. No. 16/600,147, entitled "Crossing Obstruction Detection System" and filed Oct. 11, 2019, the entire content of which is hereby incorporated by reference.

In various embodiments, an onboard system may determine location (e.g., latitude and longitude) of a vehicle along with speed, and provide the location and speed to a control system (e.g., of a back office system) at a predetermined rate (e.g., 1 Hz). The control system may then calculate the amount of time for any vehicles in a network associated with the control system to arrive at any crossings identified as obstructed. In various embodiments, an escalating scale of alerts may be provided to a dispatcher and/or operator based on the amount of time a particular object has obstructed a crossing and the estimated time of arrival of the vehicle to the crossing.

In one example, the systems and methods integrate the detection of the obstruction with a centralized control system that warns vehicles equipped with positive train control systems, and the onboard positive train control systems can automatically apply brakes to slow or stop movement of the vehicle before the vehicle collides with the obstruction. The systems and methods described herein can be used with rail vehicle systems (e.g., a train) equipped with an onboard positive train control systems. It may be noted that the systems and methods described herein may also be used with other control systems, such as negative control systems. Stationary wayside cameras can detect the presence of a vehicle (e.g., an automobile) within a crossing between a track and another type of route (e.g., a road), and alerts and/or commands provided to the vehicle as appropriate.

Not all embodiments described herein are limited to rail vehicle systems, positive train control systems, cameras, crossings between routes, slowing or stopping as a responsive action, and/or automobiles as obstructions in a crossing. For example, one or more embodiments of the detection systems and methods described herein can be used in connection with other types of vehicles, such as automobiles, trucks, buses, mining vehicles, marine vessels, aircraft, agricultural vehicles, or the like. The systems and methods can warn these other types of vehicles of obstructions to prevent collisions between the vehicles and the obstructions. As another example, one or more embodiments can be used with vehicle control systems other than positive train control systems to change movement of a vehicle responsive to receiving a warning of an obstruction.

Additionally, one or more embodiments may use sensors other than cameras to detect an obstruction. For example, radar systems, lidar systems, weight scales, or the like, may be used to detect obstructions. The obstructions may be detected in locations other than crossings (e.g., intersections) between two or more routes. For example, one or more embodiments described herein may be used to detect an obstruction along a route in a location that is not a crossing between the route and at least one other route. The onboard control systems may implement a responsive action other than slowing or stopping movement of the vehicle responsive to receiving a warning of an obstruction. For example, the onboard control systems may change which route the vehicle is traveling on to avoid colliding with the obstruction. The obstructions that are detected may be objects other than automobiles.

FIG. 1 illustrates a block schematic diagram of a network 101 that includes an obstruction alert system 100 (e.g., a crossing obstruction alert system), a detection system 200 (e.g., wayside detection system), and a vehicle 300. It may be noted that in the illustrated example, the obstruction alert system 100 is depicted as separate from the detection system 200 and vehicle 300; however, in some examples, one or more aspects of the obstruction alert system (e.g., optical sensor) and/or one or more aspects of the vehicle 300 (e.g., position sensor) may be included as part of the obstruction alert system 100. Also, in the depicted example, the obstruction alert system 100 is depicted as being disposed off-board the vehicle 300; however, in some examples, the obstruction alert system 100 may be disposed on-board the vehicle 300. Generally, in the illustrated example, the detection system 200 (e.g., an optical sensor of the detection system 200) and the position sensor 308 of the vehicle 300 provide information to the obstruction alert system 100, which determines a presence or absence of an alert state and performs (e.g., directs performance of) a responsive activity responsive to determination of the presence of an alert state.

Figure 2:
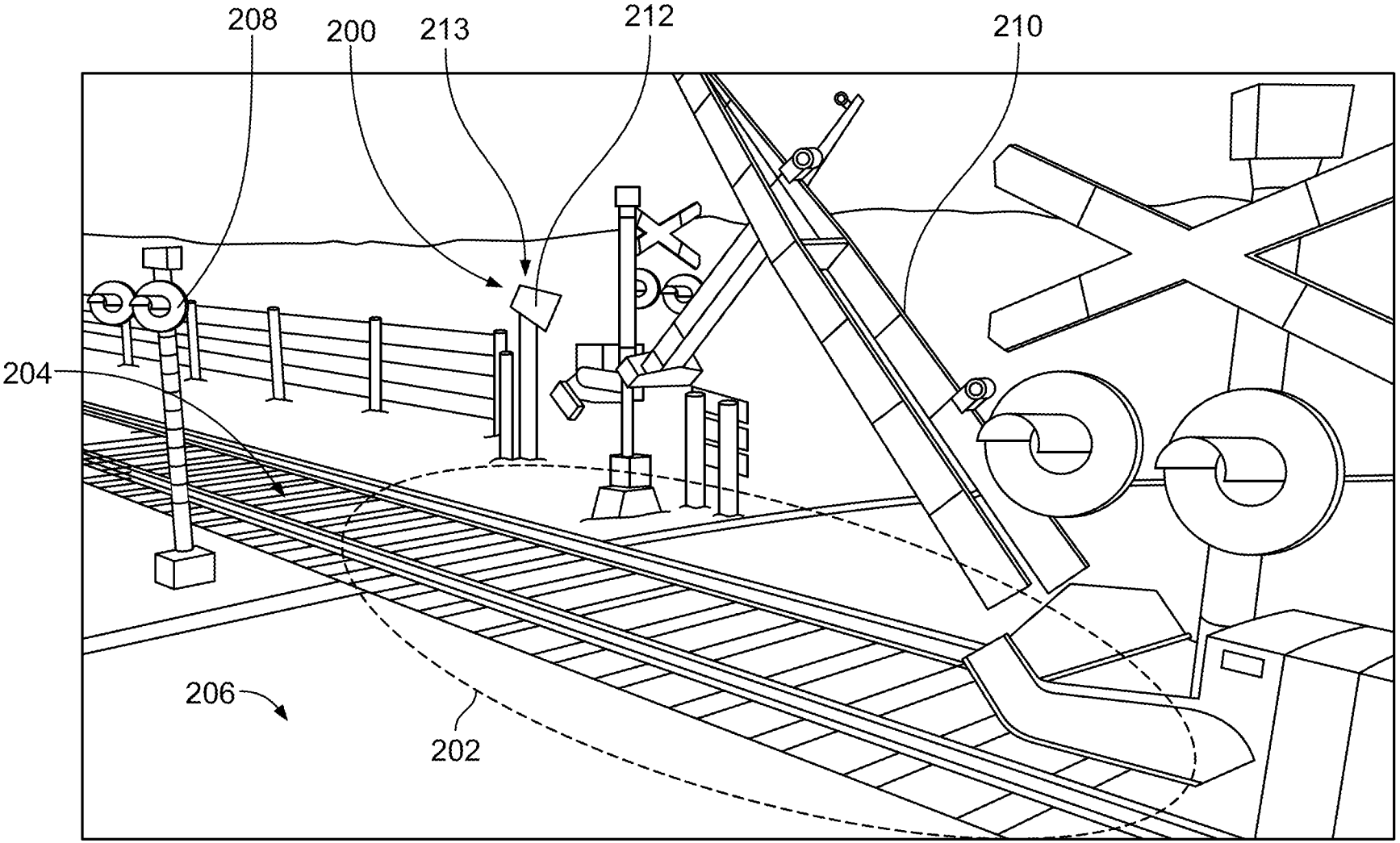
FIG. 2 illustrates an example crossing of the network of FIG. 1.

An example detection system 200 and related aspects is illustrated in greater detail in FIG. 2. As discussed herein, an optical sensor 212 is disposed proximate a crossing of a route traversed by the vehicle 300, and is configured to obtain crossing obstruction information indicating a presence of an obstruction to the crossing.

The detection system 200 may be disposed at a crossing 202 between two or more routes 204, 206. The crossing can be an intersection between the routes. The crossing can include one or more signals 208, gates 210, or the like. Optionally, the crossing does not include a signal or gate. The routes can be tracks, roads, or the like, on which vehicles travel. The signals may include lights that are activated to warn vehicles traveling on one route (e.g., the road) of a vehicle approaching on another route (e.g., the track). The gates may be lowered to impede entry of a vehicle (e.g., automobile) into the crossing when another vehicle (e.g., a train) is approaching the crossing.

The detection system includes an optical sensor 212 which is a wayside camera assembly 213 in the illustrated example. The camera assembly is configured to generate image data of the crossing. The camera assembly can be stationary in that the camera assembly does not move while the vehicles moving on the routes pass by the camera assembly. It may be noted that in other embodiments, the camera assembly (and/or other sensors discussed herein) may be mobile. For example, the camera assembly may be mounted on another vehicle, or as another example, the camera assembly may be mounted on a drone. The camera assembly includes one or more cameras having a field of view that includes the routes and/or crossing. The cameras can output data signals indicative of one or more characteristics of the routes and/or crossings. For example, the cameras can generate image or video data that is analyzed (e.g., by a controller of the camera assembly) to determine whether the image or video data indicate that a vehicle is obstructing the crossing. This controller can generate a warning signal responsive to detecting the presence of an obstruction in the crossing based on the image or video data. This warning signal optionally can be referred to as a warning bulletin. The warning signal can be communicated to a centralized location, such as a back-office server, that is off-board the vehicles traveling on the routes. The warning signal can be received by the centralized location. The centralized location can include a controller (e.g., as part of the obstruction alert system 100) that determines which vehicles are near and/or approaching the crossing, and/or how long a vehicle or other obstruction has been at a crossing. The controller of the centralized location (e.g., processing unit 110 of the obstruction alert system 100) can then, as discussed herein, determine the appropriateness of further action, and perform a responsive activity (e.g., send the same or different warning signal (e.g., wirelessly) to the vehicles that are near and/or approaching the crossing to warn these vehicles of the detected obstruction). Onboard control systems of the vehicles can apply brakes or otherwise change movement of the vehicles to slow or stop movement of the vehicles before the vehicles collide with the obstruction.

Figure 3:
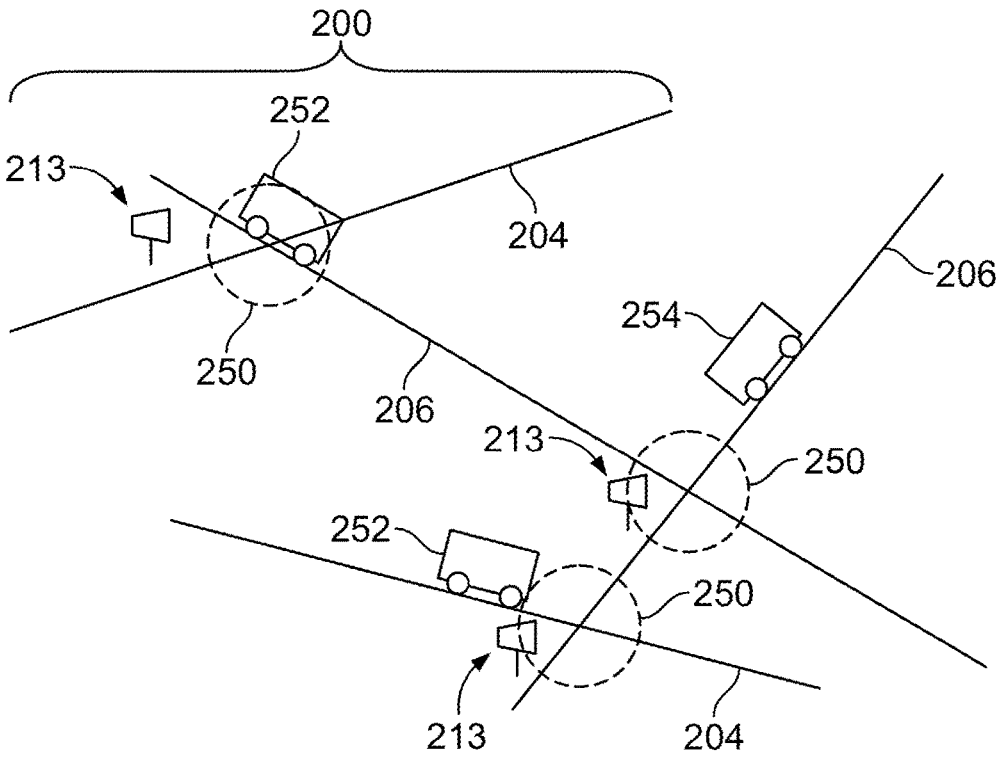
FIG. 3 illustrates a plurality of wayside camera assemblies located at several different crossings between routes.

While only one crossing is shown in FIG. 2, the detection system 200 may be used with several crossings. For example, FIG. 3 illustrates the detection system 200 communicating with several wayside camera assemblies located at several different crossings between routes. Each of the wayside camera assemblies can monitor characteristics of a different segment or portion of a route for an obstruction. For example, each wayside camera assembly can output and examine image and/or video data of a different crossing to determine whether an obstruction is present in the crossing. The wayside camera assembly can examine the characteristics of the route (e.g., the presence of an obstruction within a designated monitored area 250). This monitored area can correspond to a defined or fixed distance from the center of the crossing, can correspond to the field of view of the camera assembly, or can otherwise be defined by an operator. If the data output by the camera assembly indicates that an obstruction is present within the monitored area, then the camera assembly can determine that an obstruction is present.

The obstruction that is detected can be the presence of a vehicle 252 and/or 254 within the monitored area. In one embodiment, the vehicle 252 can represent an automobile while the vehicle 254 can represent a rail vehicle, such as a train, locomotive, or the like. But, not all embodiments of the inventive subject matter described herein are limited to automobiles and/or rail vehicles, as described above. The vehicles 252, 254 can represent other vehicles, such as both being automobiles or one or more of the vehicles 252, 254 representing buses, trucks, agricultural vehicles, mining vehicles, aircraft, marine vessels, or the like. The routes can represent tracks, roads, waterways, mining paths or tunnels, or the like.

Figure 4:
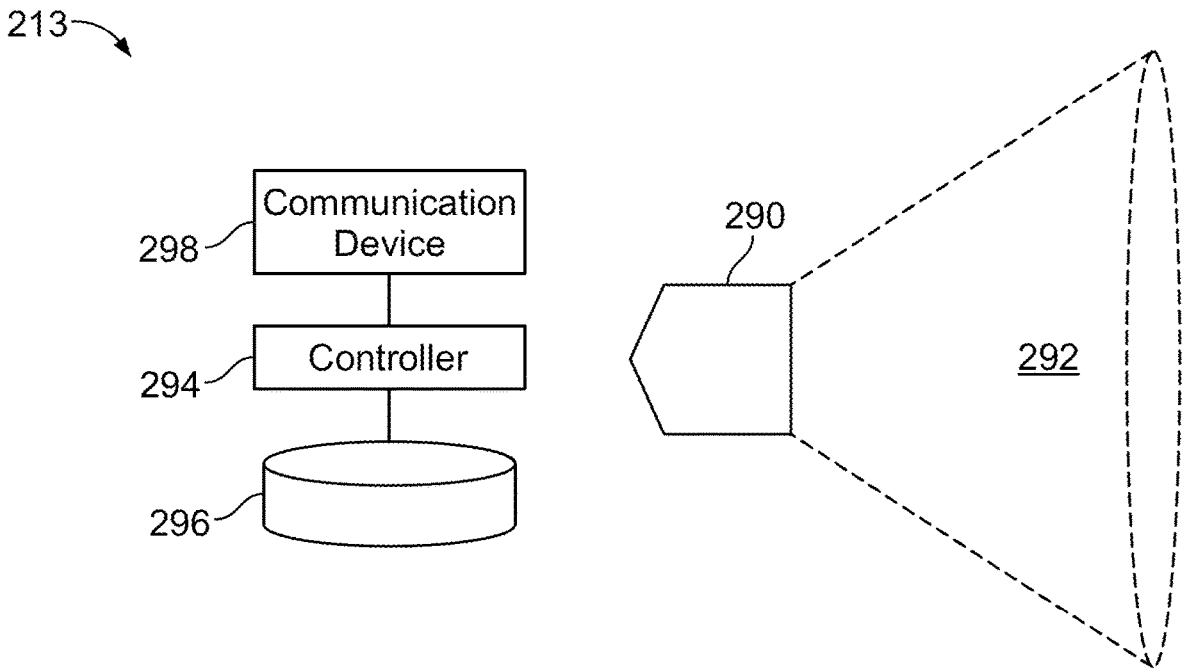
FIG. 4 illustrates one example of a wayside camera assembly for the network of FIG. 1.

With continued reference to the wayside detection system shown in FIG. 3, FIG. 4 illustrates one example of the wayside camera assembly 213 shown in FIG. 2. The wayside camera assembly includes one or more sensors 290 that monitor one or more characteristics of the monitored area of the route. The sensor can represent a camera in one embodiment that outputs static images and/or videos within a field of view 292 of the camera. A controller 294 of the camera assembly 213 receives the data output by the sensor and examines the data to determine whether an obstruction is present within the monitored area based on the data. The controller represents hardware circuitry that includes and/or is connected with one or more processors (e.g., one or more microprocessors, integrated circuits, microcontrollers, field programmable gate arrays, etc.) that perform operations described in connection with the camera assembly.

The controller can receive the sensor data and examine the sensor data to determine whether an obstruction is present. For example, with respect to image and/or video data, the controller can examine characteristics of pixels in the data to determine whether an obstruction (e.g., a vehicle) has appeared in the field of view of the camera and remain in the field of view for at least a designated period of time (e.g., thirty seconds, sixty seconds, etc.). Optionally, the controller can use one or more object detection algorithms, such as selective searching (grouping pixels having similar characteristics together and determining whether the grouped pixels represent a defined object, such as a vehicle). Alternatively, another object detection algorithm may be used.

The controller optionally can store the sensor data in a tangible and non-transitory computer-readable storage medium (e.g., memory 296 in FIG. 4). For example, responsive to determining that the sensor data indicates that an obstruction is present within the monitored area, the controller can direct the memory to electronically and/or magnetically store the sensor data.

Responsive to determining that an obstruction is present in the monitored area, the controller of the camera assembly communicates a signal to another location (e.g., a processing unit 110 of the crossing detection system 100) via a communication device 298. The communication device can represent circuitry that can communicate data signals wirelessly and/or via wired connections. For example, the communication device can represent transceiving circuitry, one or more antennas, modems, or the like, that communicate (e.g., broadcast and/or transmit) a warning signal that indicates detection of an obstruction in the monitored area. This warning signal can be sent before a vehicle approaching the monitored area reaches the monitored area.

With continued reference to FIG. 1, the vehicle 300 shown in FIG. 1 can represent one or more of the vehicles 252, 254 shown in FIG. 3. The depicted example vehicle 300 is shown as a land-based vehicle, such as a rail vehicle (e.g., locomotive), but optionally can be another type of land-based vehicle or may be a vehicle that travels via waterways and/or the air. The vehicle includes a controller 302 that represents one or more processors that control movement and other operations of the vehicle. This controller can be referred to as a vehicle controller. The vehicle controller can represent an engine control unit, an onboard navigation system, or the like, that can control a propulsion system (e.g., one or more engines, motors, etc.) and/or a braking system (e.g., one or more friction brakes, air brakes, regenerative brakes, etc.) to control movement of the vehicle.

The vehicle optionally includes a control system 304 that communicates with one or more off-board control systems (e.g., the obstruction alert system 100 and/or a system including or associated with the obstruction alert system 100) for limiting where and/or when the vehicle can move. For example, the control system onboard the vehicle can be referred to as a vehicle control system that can automatically apply brakes of the vehicle to slow or stop the vehicle based on warning bulletins received from the obstruction alert system 100. In one embodiment, the vehicle control system is an onboard component of a positive train control system that limits where and when the vehicle can move based on movement authorities, locations of other vehicles, or the like.

Communications from the crossing obstruction alert system 100 can be received by the vehicle controller and/or vehicle control system via a communication device 306, which may also provide information from the position sensor 308 to the crossing obstruction alert system 100. This communication device can include an antenna and wireless transceiving circuitry that wirelessly communicates signals with other communication devices described herein. A tangible and non-transitory computer-readable storage medium (e.g., a memory 310) of the vehicle may store locations and/or layouts of the routes, locations of the monitored areas, identities of the camera assemblies and the monitored areas examined by the camera assemblies, etc.

The vehicle control system can receive alerts, commands, or other messages sent from the crossing obstruction alert system 100 and/or other off-board control system and can apply the brakes of the vehicle and/or control the propulsion system of the vehicle to slow or stop movement of the vehicle responsive to receiving the warning bulletin. For example, the onboard positive train control system of the vehicle can receive a message corresponding to an obstruction in a crossing. The onboard positive train control system can then warn an onboard operator to engage the brakes or can automatically apply the brakes to prevent a collision between the vehicle and the obstruction. Alternatively, the vehicle control system in some embodiments is not a positive train control system. The vehicle control system can receive the warning bulletin or signal from the off-board control system and engage the brakes or otherwise act to slow or stop movement of the vehicle.

The depicted example vehicle 300 includes one or more position sensors 308 that determine locations and/or headings of the vehicles. The position sensor can represent a global positioning system receiver, a wireless triangulation system, a dead reckoning system, inertial sensor, speedometer, or the like, that determines locations and/or headings of the vehicle. The locations and/or headings of the vehicles can be determined by the position sensors and communicated from the vehicles to the crossing obstruction alert system 100.

As discussed herein, position information may be used to determine the proximity of a particular vehicle to a particular crossing associated with an obstruction. It may also be noted that position information may also be used to identify or select which vehicles among a group of vehicles should be analyzed for determining proximity information. For example, a warning signal received by the crossing obstruction alert system 100 from the optical sensor 212 can identify the location of the monitored area where the obstruction is detected and/or can identify the camera assembly that detected the obstruction. The locations of the camera assemblies can be associated with different monitored areas, and the crossing obstruction alert system 100 can determine the location of the obstruction from the warning signal and/or the identity of the camera assembly that sent the warning signal. Then, the crossing obstruction alert system 100 can determine which, if any, vehicles are sent an alert or other message or command.

In some examples, the obstruction alert system 100 may be understood as including or incorporating the optical sensor 212 and the position sensor 308. In other embodiments, the obstruction alert system 100 may be understood as separate from the optical sensor 212 and the position sensor 308 and configured to receive information from the sensors. The depicted example obstruction alert system 100 includes a processing unit 110, memory 112, and communication unit 114. The communication unit 114 is configured to exchange messages or information with aspects of the detection system 200 and the vehicle 300. For example, the communication unit 114 may be used to receive information from the optical sensor 212 and the position sensor 308, and/or to provide messages (e.g., alerts, commands, or other information) to the vehicle 300. In some embodiments, the obstruction alert system forms a portion of a back office server of a positive train control (PTC) system. Alternatively, the obstruction alert system 100 may be configured as or form a part of another system that monitors movements of the vehicles to ensure safe travel of the vehicles. For example, the obstruction alert system 100 may be a portion of or associated with a dispatch facility, a scheduling facility, or the like.

Generally, the processing unit 110 represents one or more processors configured (e.g., programmed) to perform various tasks or activities discussed herein. For example, the depicted example processing unit 110 is configured to obtain or receive position information (e.g., information indicating a position of the vehicle traversing a route) from the position sensor, and to receive crossing obstruction information (e.g., information indicating a presence of an obstruction to the crossing) from the optical sensor 212. The processing unit 110 is also configured to determine proximity information of the vehicle 300 indicating proximity of the vehicle to the crossing using the position information. Further, the processing unit 110 is configured to determine a presence or absence of an alert state indicating a potential of the crossing being obstructed using the crossing obstruction information and the proximity information, and perform a responsive activity responsive to a determination of the presence of the alert state.

It may be noted that, for ease and clarity of illustration, in the depicted example, the processing unit 110 is shown as a single unit; however, in various embodiments the processing unit 110 may be distributed among or include more than one physical unit, and may be understood as representing one or more processors. The processing unit 110 represents hardware circuitry that includes and/or is connected with one or more processors (e.g., one or more microprocessors, integrated circuits, microcontrollers, field programmable gate arrays, etc.) that perform operations described herein. The processing unit 110 in various embodiments stores acquired information (e.g., information regarding the location of crossings, information regarding the position of one or more vehicles, information regarding identified obstructions to one or more crossings) in a tangible and non-transitory computer-readable storage medium (e.g., memory 112). Additionally or alternatively, instructions for causing the processing unit 110 to perform one or more tasks discussed herein may be stored in a tangible and non-transitory computer-readable storage medium (e.g., memory 112).

As discussed herein, the processing unit 110 receives crossing obstruction information from the optical sensor 212. The crossing obstruction information may include information describing the presence of an obstruction at a crossing, the type of obstruction (e.g., car), and/or an amount of time for which the obstruction has been in the crossing. The crossing obstruction information may also include an identification of the particular crossing and/or location of the crossing for which an obstruction has been detected.

The processing unit 110 also obtains the position information from the position sensor 308. The position information indicates a position of the vehicle 300 traversing a particular route (e.g., a route on which a crossing is disposed along). The position information in various embodiments is obtained from a location signal communicated from onboard the vehicle 300 (e.g., from communication device 306 providing information from position sensor 308). The position information in various examples may include information describing a current location of the vehicle 300 (e.g., a geographical location and/or an identification of a particular route on which the vehicle 300 is disposed) and/or movement information (e.g., a speed travelled by the vehicle 300 and a direction of travel). In some examples, the processing unit 110 receives position information at predetermined time intervals for a given vehicle to monitor and update a determined position of the vehicle and/or to determine a speed of the vehicle.

The processing unit 110 is further configured (e.g., programmed) to determine proximity information of the vehicle. The proximity information indicates a proximity of the vehicle 300 to a particular crossing (e.g., a crossing for which the processing unit 110 has received obstruction information indicating an obstruction at the crossing). For example, the proximity information may include a distance of the vehicle 300 from an obstructed crossing. In some embodiments, the proximity information includes an estimated time of arrival for the vehicle 300 at the crossing. For example, the processing unit 110 in some examples determines an estimated time of arrival using the position information and an estimated speed of the vehicle. By knowing the geographical position of the vehicle from the position information, as well as the geographical position of the crossing from archived information, a distance from the vehicle 300 to the crossing may be determined. The distance may be in terms of a distance between coordinates of the vehicle and the crossing, or, as another example, may be in terms of mileposts or other measurements of distance along a particular route. With the distance and speed known, a time of arrival (e.g., an elapsed time from a current time) may be estimated or determined.

Various different estimated or measured speeds may be used in determining the time of arrival. In one example, the position information includes a current speed of the vehicle (e.g., as measured by a speedometer of the vehicle), which may be used to determine an estimated time of arrival. In another example, the estimated speed of the vehicle 300 is determined using a plurality of location signals received from the vehicle 300. For example, by determining the locations at various times along with the amount of times between readings, the processing unit 110 may estimate a speed of the vehicle 300. Additionally or alternatively, non-measured information may be used to estimate the speed. For example, a predetermined upper speed limit of the vehicle 300 may be used. As another example, a speed of the vehicle 300 as called for by a trip plan may be used. In some embodiments, multiple speeds may be estimated (e.g., one speed using a current measured speed, a second speed using a planned speed, a third speed using a historical average of similar vehicles on similar routes) and the highest speed used to determine the estimated time of arrival.

Next, using the crossing obstruction information and the proximity information, the processing unit 110 determines a presence or absence of an alert state. The alert state indicates a potential of a collision at the crossing. Various factors may be considered individually or in combination to help determine the presence or absence of an alert state. For example, the closer the vehicle 300 is to the crossing may be used to increase the likelihood of an alert state and/or increase the level of an alert state. As another example, the shorter the estimated time to arrival may be used to increase the likelihood of an alert state and/or increase the level of an alert state. As one more example, the longer amount of time that an obstruction has remained in the crossing may be used to increase the likelihood of an alert state and/or increase the level of an alert state. For example, in some embodiments, the alert state indicates that the vehicle is within a threshold time (or distance) for which one or more alerts are appropriate. Accordingly, alerts or other messages or commands may be sent when appropriate, but false or unnecessary alarms for crossing located a sufficient distance away may be avoided. Responsive to a determination of the presence of the alert state, the processing unit 110 performs a responsive activity. If no alert state is determined for a current position of a vehicle 300, no immediate action may be taken, but the position of the vehicle 300 may be periodically updated and the estimated arrival time updated and monitored, with an alert or other responsive step taken subsequently as appropriate based on the updated and monitored position of the vehicle 300.

Various types of responsive actions may be taken in different embodiments. For example, an alert or other message may be sent to the vehicle 300 for review and/or implementation by an operator. As another example, a signal 170 may be disposed along the route, and the responsive activity may include operating the signal 170. For instance, the signal 170 may be configured to provide a visual display to an operator of the passing vehicle, and the processing unit 110 may send a control signal to the signal 170 to display an appropriate warning. As another example, the signal 170 may be associated with a switch, and the processing unit 110 may send a control signal to the signal 170 to operate the switch and transfer the vehicle 300 to a different track for which there is no upcoming obstructed crossing. As one more example, the processing unit 110 may perform a responsive action of sending a control signal to the vehicle 300 that causes a change in the operation of the vehicle 300 (e.g., reduction of throttle, application of brakes). In some examples, the responsive activity includes transmitting a signal to the vehicle 300 that over-rides a current operation of the vehicle 300.

It may be noted that the alert state may include a variety of alert levels. For example, the processing unit 110 may determine an alert level using the proximity information and the crossing obstruction information responsive to determining the presence of an alert state. The alert level may be selected from a group of different hierarchically-ranked alert levels. For example, a higher or more immediate alert level may be selected based on a relatively shorter estimated arrival time and/or a relatively longer duration of obstruction, while a lower or less immediate alert level may be selected based on a relatively longer estimated arrival time and/or a relatively shorter duration of obstruction.

Further, the responsive activity may be selected by the processing unit 110 from different hierarchically-ranked remedial activities corresponding to the hierarchically ranked alert levels. In one example, for a first, lowest level alert, an informational message may be sent to an operator. The informational message, for example, may identify an upcoming crossing that is obstructed along with a distance to the crossing or estimated time of arrival. For a second, intermediate level alert, a command message may be sent, instructing the operator to perform one or more steps to slow the vehicle and/or alter a course of the vehicle. For a third, higher level alert, a command signal may be sent to the vehicle to autonomously implement a corrective action to slow the vehicle and/or alter a course of the vehicle without operator intervention. For example, an alert level may represent a risk of collision, with responsive activities selected as appropriate for the level of risk of collision. For example, if an expected risk of collision is 100%, then full braking may be automatically implemented, or the vehicle may be diverted to another route. As another example, if an expected risk of collision is 20%, a dispatcher or operator may be ordered to consider additional information (e.g., information on a monitor) and decide on an action.

Figure 5:
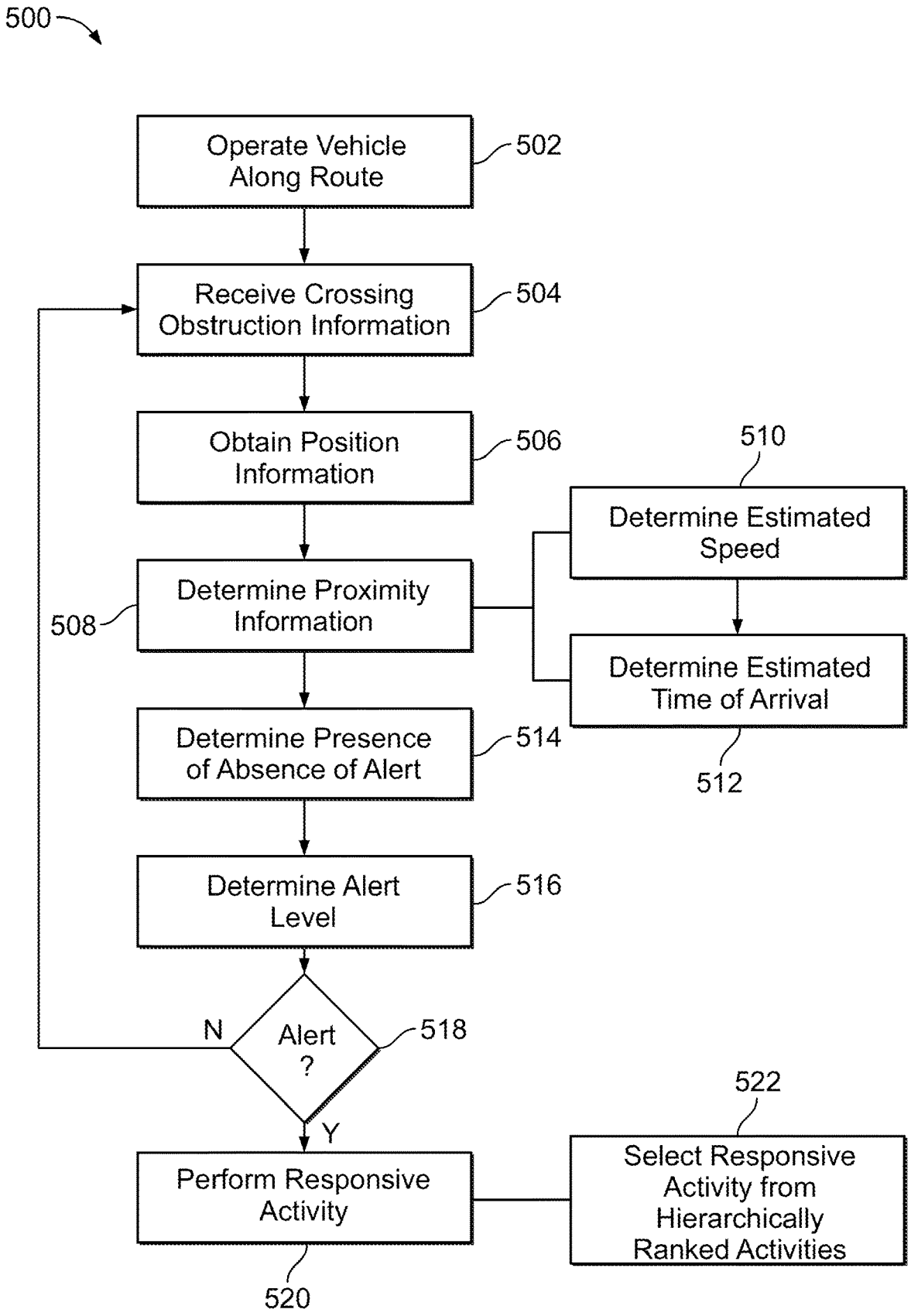
FIG. 5 illustrates a flowchart of one example of a method for detecting an obstruction of a route.

FIG. 5 illustrates a flowchart of one example of a method 500. The method 500, for example, may employ or be performed by structures or aspects of various embodiments (e.g., systems and/or methods and/or process flows) discussed herein. In various embodiments, certain steps may be omitted or added, certain steps may be combined, certain steps may be performed concurrently, certain steps may be split into multiple steps, certain steps may be performed in a different order, or certain steps or series of steps may be re-performed in an iterative fashion. In various embodiments, portions, aspects, and/or variations of the method 500 may be able to be used as one or more algorithms to direct hardware (e.g., one or more aspects of the processing unit 110) to perform one or more operations described herein.

At 502, a vehicle is operated to perform a mission along a route. At 504, during performance of the mission of the vehicle, crossing obstruction information is received from an optical sensor disposed proximate a crossing of a route traversed by a vehicle. One or more crossings may be monitored by corresponding optical sensors, and crossing obstruction information sent from any optical sensors that detect an obstruction. The crossing obstruction information indicates a presence of an obstruction to the crossing. The crossing obstruction information in various examples includes an identification (e.g., by location) of the particular crossing that is obstructed, the length of time the crossing has been obstructed, and/or the type of obstruction. The crossing obstruction information may be received by a control system (e.g., crossing obstruction alert system) that is disposed off-board the vehicle in some embodiments, and on-board in others. It may be noted that the in the illustrated example relates to obstructions at crossing; however, other embodiments may relate to other types of obstructions additionally or alternatively to crossing obstructions.

At 506, position information is obtained (e.g., by the same control system that received the crossing obstruction information). The position information indicates a position of the vehicle as it traverses the route. The position information in various examples indicates a geographic position of the vehicle, a position of the vehicle with respect to predetermined route intervals (e.g., mileposts), and/or a speed and direction of the vehicle. As one example, the position information may be sent from the vehicle (e.g., periodically), or as another example, the position information may be sent from the vehicle pursuant to a request (e.g., from processing unit 110) after receipt of crossing obstruction information.

At 508, proximity information of the vehicle is determined (e.g., by the control system receiving the position and crossing obstruction information). The proximity information indicates a proximity of the vehicle to the crossing, and may be determined using the position information. The proximity information may be expressed in terms of distance and/or time from the obstructed crossing. For example, in the illustrated example, at 510, an estimated speed of the vehicle is determined, and, at 512, an estimated time of arrival for the vehicle at the obstructed crossing is determined using the position information (e.g., geographic location) and the estimated speed of the vehicle. In various examples, the speed of the vehicle may be part of the received position information; may be estimated from a predetermined trip plan, average speed, or permitted speed limit; or may be determined from multiple location readings over known periods of time.

At 514, the presence or absence of an alert state indicating a potential of the crossing being obstructed (e.g., at an estimated time of arrival at the crossing by the vehicle) is determined using the crossing obstruction information and the proximity information. In the illustrated example, responsive to the determination of an alert state, an alert level is determined at 516. The alert level is determined using the proximity information and the crossing obstruction information. In some examples, the alert level is selected from different hierarchically-ranked alert levels as discussed herein.

At 518 it is determined if an alert state has been identified. If there is no alert state, the depicted method 500 returns to 504 to obtain updated crossing obstruction information and position information to monitor the mission for upcoming potential alert states. If there is an alert state, at 520, responsive to the determination of the presence of the alert state, a responsive activity is performed. The responsive activity may include, for example, sending an alert to the vehicle (e.g., an operator of the vehicle) and/or sending a command signal to the vehicle altering operation of the vehicle (e.g., applying brakes and/or reducing throttle). Alternatively or additionally, the responsive activity may include operating a signal disposed along the route associated with the crossing, and/or over-riding a current operation of the vehicle (e.g., as performed by an operator)

In the illustrated example, at 522, the responsive activity is selected from different hierarchically ranked remedial activities corresponding to the alert levels discussed in connection with step 516.

In one embodiment, a system includes one or more processors. The one or more processors are configured to receive crossing obstruction information from an optical sensor disposed proximate a crossing of a route traversed by a vehicle, with the crossing obstruction information indicating a presence of an obstruction to the crossing; obtain position information indicating a position of the vehicle traversing the route; determine proximity information of the vehicle indicating proximity of the vehicle to the crossing using the position information; determine a presence or absence of an alert state indicating a potential of the crossing being obstructed using the crossing obstruction information and the proximity information; and perform a responsive activity based responsive to a determination of the presence of the alert state.

Optionally, the one or more processors are configured to obtain the position information from a location signal communicated from onboard the vehicle.

Optionally, the proximity information includes an estimated time of arrival for the vehicle at the crossing, and the one or more processors are configured to determine the estimated time of arrival using the position information and an estimated speed of the vehicle. In an example, the one or more processors are configured to determine the estimated speed of the vehicle using a plurality of location signals received from the vehicle. In another example, the one or more processors are configured to determine the estimated speed of the vehicle using a predetermined upper speed limit of the vehicle.

Optionally, the one or more processors are configured to determine an alert level using the proximity information and the crossing obstruction information responsive to determining the presence of an alert state. In an example, the one or more processors are configured to select the alert level from different hierarchically-ranked alert levels. For instance, the one or more processors in various examples are configured to select the responsive activity from different hierarchically-ranked remedial activities corresponding to the hierarchically-ranked alert levels.

Optionally, the responsive activity comprises communicating an alert message to the vehicle.

Optionally, the responsive activity comprises operating a signal device disposed along the route associated with the crossing.

Optionally, the responsive activity comprises communicating to a control signal configured to over-ride a current operation of the vehicle.

In an embodiment, a method includes receiving crossing obstruction information from an optical sensor disposed proximate a crossing of a route traversed by a vehicle, the crossing obstruction information indicating a presence of an obstruction to the crossing. The method also includes obtaining position information from the vehicle indicating a position of the vehicle traversing the route, and determining proximity information of the vehicle indicating proximity of the vehicle to the crossing using the position information. Further, the method includes determining a presence or absence of an alert state indicating a potential of the crossing being obstructed using the crossing obstruction information and the proximity information. The method also includes performing a responsive activity responsive to a determination of the presence of the alert state.

Optionally, determining the proximity information includes determining an estimated speed of the vehicle, and determining an estimated time of arrival for the vehicle at the crossing using the position information and an estimated speed of the vehicle.

Optionally, the method further includes determining an alert level using the proximity information and the crossing obstruction information responsive to determining the presence of an alert state. In an example, the method includes selecting the alert level from different hierarchically-ranked alert levels, selecting the responsive activity from different hierarchically-ranked remedial activities corresponding to the hierarchically-ranked alert levels.

Optionally, performing the responsive activity includes transmitting an alert message to the vehicle.

Optionally, performing the responsive activity includes operating a signal disposed along the route associated with the crossing.

Optionally, performing the responsive activity includes over-riding a current operation of the vehicle.

In one embodiment, a system includes an optical sensor, a position sensor, and one or more processors. The optical sensor is disposed proximate a crossing of a route traversed by a vehicle, and is configured to obtain crossing obstruction information indicating a presence of an obstruction to the crossing. The position sensor is configured to be disposed onboard the vehicle, and is configured to obtain position information indicating a position of the vehicle traversing the route. The one or more processors are configured to receive the crossing obstruction information from the optical sensor; obtain the position information from the position sensor; determine proximity information of the vehicle indicating proximity of the vehicle to the crossing using the position information; determine a presence or absence of an alert state indicating a potential of the crossing being obstructed using the crossing obstruction information and the proximity information; and perform a responsive activity responsive to a determination of the presence of the alert state.

Optionally, the proximity information includes an estimated time of arrival for the vehicle at the crossing, and the one or more processors are configured to determine the estimated time of arrival using the position information and an estimated speed of the vehicle.

Optionally, the one or more processors are configured to determine an alert level using the proximity information and the crossing obstruction information responsive to determining the presence of an alert state. In an example, the one or more processors are configured to select the alert level from different hierarchically-ranked alert levels, and to select the responsive activity from different hierarchically-ranked remedial activities corresponding to the hierarchically ranked alert levels.

Optionally, the responsive activity comprises transmitting an alert message to the vehicle.

Optionally, the system further includes a signal disposed along the route associated with the crossing, and the responsive activity comprises operating the signal.

Optionally, the responsive activity comprises transmitting to the vehicle a control signal configured to over-ride a current operation of the vehicle.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

one or more processors configured to:

receive, separately of gates of a crossing system, crossing obstruction information from an optical sensor disposed proximate a crossing of a route traversed by a vehicle, the crossing obstruction information indicating a presence of an obstruction to the crossing and a measured duration that the obstruction is in the crossing;

obtain position information indicating a position of the vehicle traversing the route, wherein the position information is obtained and updated at predetermined time intervals;

determine proximity information of the vehicle indicating proximity of the vehicle to the crossing using the position information;

determine, separately of the gates of the crossing system, a presence or absence of an alert state indicating a potential of the crossing being obstructed using the crossing obstruction information and the proximity information, wherein the presence or absence of the alert state is determined using the position information obtained and updated at the predetermined time intervals; and select a responsive activity from hierarchically-ranked alert levels responsive to determining the alert state, the responsive activity selected from the alert levels based on the proximity information of the vehicle and the measured duration that the obstruction is in the crossing, the hierarchically-ranked alert levels including a first level that sends an informational message to the vehicle, a second level that sends an instruction message to the vehicle to instruct an operator of the vehicle to change movement of the vehicle, and a third level that sends a command message to the vehicle to autonomously change the movement of the vehicle.

2. The system of claim 1, wherein the one or more processors are configured to obtain the position information from a location signal communicated from onboard the vehicle.

3. The system of claim 1, wherein the proximity information includes an estimated time of arrival for the vehicle at the crossing, the one or more processors configured to determine the estimated time of arrival using the position information and an estimated speed of the vehicle.

4. The system of claim 3, wherein the one or more processors are configured to determine the estimated speed of the vehicle using a plurality of location signals received from the vehicle.

5. The system of claim 3, wherein the one or more processors are configured to determine the estimated speed of the vehicle using a predetermined upper speed limit of the vehicle.

6. The system of claim 3, wherein the one or more processors are configured to determine the alert level using the estimated time of arrival and the crossing obstruction information when the alert state is determined to be present.

7. The system of claim 3, wherein the one or more processors are configured to determine the alert level using the estimated speed of the vehicle, the proximity information, and the crossing obstruction information when the alert state is determined to be present.

8. The system of claim 3, wherein the one or more processors are configured to determine the alert level using the estimated time of arrival, the proximity information, and the crossing obstruction information when the alert state is determined to be present.

9. The system of claim 1, wherein a fourth level of the hierarchically-ranked alert levels includes operating a switch to transfer the vehicle to a different route for which there is no upcoming obstructed crossing.

10. The system of claim 1, wherein a fifth level of the hierarchically-ranked alert levels includes operating a signal device disposed along the route associated with the crossing.

11. The system of claim 1, wherein a sixth level of the hierarchically-ranked alert levels includes communicating to a control signal configured to over-ride a current operation of the vehicle.

12. A method comprising:

receiving, separately of gates of a crossing system, crossing obstruction information from an optical sensor disposed proximate a crossing of a route traversed by a vehicle, the crossing obstruction information indicating a presence of an obstruction to the crossing and a measured duration that the obstruction is in the crossing;

obtaining position information from the vehicle indicating a position of the vehicle traversing the route, where the position information is obtained and updated at predetermined time intervals;

determining proximity information of the vehicle indicating proximity of the vehicle to the crossing using the position information;

determining, separately of the gates of the crossing system, a presence or absence of an alert state indicating a potential of the crossing being obstructed using the crossing obstruction information and the proximity information, wherein the presence or absence of the alert state is determined using the position information obtained and updated at the predetermined time intervals; and selecting a responsive activity from hierarchically-ranked alert levels responsive to determining the alert state, the responsive activity selected from the alert levels based on the proximity information of the vehicle and the duration that the obstruction is in the crossing, the hierarchically-ranked alert levels including a first level that sends an informational message to the vehicle, an second level that sends an instruction message to the vehicle to instruct an operator of the vehicle to change movement of the vehicle, and a third level that sends a command message to the vehicle to autonomously change the movement of the vehicle.

13. The method of claim 12, wherein determining the proximity information comprises:

determining an estimated speed of the vehicle; and determining an estimated time of arrival for the vehicle at the crossing using the position information and an estimated speed of the vehicle.

14. The method of claim 13, further comprising determining the alert level using the estimated time of arrival and the crossing obstruction information when the alert state is determined to be present.

15. The method of claim 13, further comprising determining the alert level using the estimated speed of the vehicle, the proximity information, and the crossing obstruction information when the alert state is determined to be present.

16. The method of claim 12, wherein a fourth level of the hierarchically-ranked alert levels includes operating a switch to transfer the vehicle to a different route for which there is no upcoming obstructed crossing.

17. The method of claim 12, wherein a fifth level of the hierarchically-ranked alert levels includes operating a signal disposed along the route associated with the crossing.

18. The method of claim 12, wherein a sixth level of the hierarchically-ranked alert levels includes communicating to a control signal configured to over-riding a current operation of the vehicle.

19. A system comprising:

an optical sensor disposed proximate a crossing of a route traversed by a vehicle, the optical sensor configured to obtain crossing obstruction information indicating a presence of an obstruction to the crossing and a measured duration that the obstruction is in the crossing;

a position sensor configured to be disposed onboard the vehicle, the position sensor configured to obtain position information indicating a position of the vehicle traversing the route; and one or more processors configured to:

receive, separately of gates of a crossing system, the crossing obstruction information from the optical sensor;

obtain the position information from the position sensor, wherein the position information is obtained and updated at predetermined time intervals;

determine proximity information of the vehicle indicating proximity of the vehicle to the crossing using the position information;

determine, separately of the gates of the crossing system, a presence or absence of an alert state indicating a potential of the crossing being obstructed using the crossing obstruction information and the proximity information, wherein the presence or absence of the alert state is determined using the position information obtained and updated at the predetermined time intervals; and select a responsive activity from hierarchically-ranked alert levels responsive to determining the alert state, the responsive activity selected from the alert levels based on the proximity information of the vehicle and the duration that the obstruction is in the crossing, the hierarchically-ranked alert levels including a first level that sends an informational message to the vehicle, an second level that sends an instruction message to an operator of the vehicle to change movement of the vehicle, and a third level that sends a command message to the vehicle to autonomously change the movement of the vehicle.

20. The system of claim 19, wherein the proximity information includes an estimated time of arrival for the vehicle at the crossing, the one or more processors configured to determine the estimated time of arrival using the position information and an estimated speed of the vehicle.

21. The system of claim 20, wherein the one or more processors are configured to determine the alert level using the estimated time of arrival and the crossing obstruction information when the alert state is determined to be present.

22. The system of claim 20, wherein the one or more processors are configured to determine the alert level using the estimated speed of the vehicle, the proximity information, and the crossing obstruction information when the alert state is determined to be present.

23. The system of claim 19, wherein a fourth level of the hierarchically-ranked alert levels includes operating a switch to transfer the vehicle to a different track for which there is no upcoming obstructed crossing.

24. The system of claim 19 wherein a fifth level of the hierarchically-ranked alert levels includes operating a signal device disposed along the route associated with the crossing.

25. The system of claim 19, wherein a sixth level of the hierarchically-ranked alert levels includes transmitting to the vehicle a control signal configured to over-ride a current operation of the vehicle.

* * * * *